US006267588B1

(12) United States Patent
Querol

(10) Patent No.: US 6,267,588 B1
(45) Date of Patent: Jul. 31, 2001

(54) LONGITUDINAL CONTINUOUS FURNACE APPLICABLE TO CONSTRUCTION CERAMIC MATERIAL

(76) Inventor: Joaquin Plana Querol, Avda. Costa Blanca, 117, Edificio Aries, 2° E, 03540 Playa de San Juan (ES)

( * ) Notice: Subject to any disclaimer, the term of this patent is extended or adjusted under 35 U.S.C. 154(b) by 0 days.

(21) Appl. No.: 09/462,539

(22) PCT Filed: May 10, 1999

(86) PCT No.: PCT/ES99/00126

§ 371 Date: Jan. 10, 2000

§ 102(e) Date: Jan. 10, 2000

(87) PCT Pub. No.: WO99/58918

PCT Pub. Date: Nov. 18, 1999

(30) Foreign Application Priority Data

May 12, 1998 (ES) ..... 9801216

(51) Int. Cl.[7] ..... F27B 9/26

(52) U.S. Cl. ..... 432/145; 432/121; 432/137

(58) Field of Search ..... 432/121, 136, 432/137, 143, 145, 146, 153, 196, 198, 201

(56) References Cited

U.S. PATENT DOCUMENTS

| | | | | |
|---|---|---|---|---|
| 3,854,865 | * | 12/1974 | Fay | 432/137 |
| 4,136,624 | * | 1/1979 | Kato et al. | 432/153 |
| 4,177,035 | * | 12/1979 | Buschermohle | 432/121 |
| 4,240,788 | * | 12/1980 | Naito et al. | 432/136 |

* cited by examiner

*Primary Examiner*—Gregory Wilson
(74) *Attorney, Agent, or Firm*—Harrison & Egbert

(57) ABSTRACT

A longitudinal continuous furnace applicable to construction ceramic material, including a main body (1) lined inside with refractory brick provided internally with a row of nozzles (2) intended to diffuse hot air generated by coaxial gas burners (4), air blowers (3) arranged on the opposite wall which inject pressure air at room temperature from the outside, rails (7) placed on the ground provided for the circulation of wagons (6) which transport the bricks to be burnt (5), and a skirt (8) arranged inside at the height at which travels the horizontal top surface of the wagons (6).

2 Claims, 2 Drawing Sheets

LONGITUDINAL CONTINUOUS FURNACE APPLICABLE TO CONSTRUCTION CERAMIC MATERIAL

TECHNICAL FIELD

The present invention relates to a longitudinal continuous furnace applicable to construction material. The use of which lies in its configuration as a mechanism that causes the drying and baking of the clay with which the construction ceramic material is manufactured so that it acquires its own characteristics.

BACKGROUND ART

The invention permits the drying and baking of clay by means of providing heat that uses pressurized air as the conductor element. This characteristic gives it good performance and effectiveness for the work entrusted. At the same times the configuration as a longitudinal and continuous furnace provides the invention with a high degree of automation of the drying and baking process and avoids time associated with conventional discontinuous furnaces.

The invention has its scope within the industry dedicated to the manufacture of industrial furnaces. More specifically within the industry dedicated to the manufacture of industrial furnaces, the present invention applies to construction ceramic materials.

Manufacture of construction ceramic material is based on two fundamental activities: molding and baking. The first of which is normally carried out by introducing the unworked clay under pressure into molds in the hollow shape of the brick section it is desired to form, and obtaining a continuous form of plastic clay that is subsequently cut into the desired lengths by means of a wire or similar.

So that the clay has homogeneous properties and does not have air bubbles, it is made to pass through rollers located before being molded under pressure. This is usually carried out by means of an endless screw that places the clay in the above described molds.

Once the plastic and wet clay bricks are obtained in the length and sections desired, they are grouped together and placed in a furnace which first dries them at moderate temperature and then bakes them at an appreciably higher temperature.

The furnaces normally used are of the discontinuous and very large type which must be heated before placing the load of bricks to be dried and baked inside them. After approximately thirty hours, the heat supply is cut off and the furnace is slowly cooled in order to extract the product.

The process is slow and the size of the furnaces, although directly dependent on the capacity of the plant, is usually very large.

It would be advisable to have furnaces applicable to the manufacture of construction ceramic material that decreased the time the product is inside them and that reduced their general size. These improvements would give rise to a proportional decrease in the investment, proportional to the size, and in the operating costs, proportional to the time the bricks are inside the furnace.

The applicant, on the other hand, has no record of the existence of longitudinal continuous furnaces specifically applicable to the drying and baking of construction ceramic material.

SUMMARY OF THE INVENTION

The longitudinal continuous furnace applicable to construction ceramic material, constitutes an obvious novelty within its field of application. It allows the drying and baking of construction ceramic material in a substantially shorter time than the conventional discontinuous furnaces applicable to this field, and with a smaller-sized furnace the characteristics indicated as desirable for a device of this type are thus obtained.

More specifically, the invention consists of a main body of the furnace in the shape of a very long and squared section tunnel. The furnace is inside with refractory bricks and provided with rails on the floor along which low speed wagons that transport groups of bricks through it circulate.

There are two types of devices on the lateral walls of the main body of the furnace that inject air, inside. There are nozzles located on one of the interior lateral faces that blow hot air coming from gas burners located outside. On the opposite internal face, there are fans that blow outside air at ambient temperature which, together with the previous ones, obtain spiral currents. The axis of the currents is parallel to the large size of the main body of the tunnel.

In this way, the hot air in motion reaches all the points of the bricks conveyed on the wagons, accelerating the drying and baking processes in comparison to the conventional furnaces. In other words, while the transmittal of heat in traditional furnaces is basically made by radiation, in this invention it is made by convection.

The calories provided inside the invention by the nozzles can be regulated by varying the gas flow burnt per unit of time in same. Thus the temperature throughout the main body of the furnace can be varied at will, creating a drying area with a suitable temperature in the initial area of the main body of the furnace, followed by a second high temperature area suitable for the baking of the bricks and a third area, in the final section of the main body of the furnace, with progressive temperature reduction in order to reach slow cooling of the bricks so that stresses in bricks are not created.

The speed of the wagons must be studied so that, due to the length of the main body of the furnace, the time the bricks are inside said furnace is suitable.

BRIEF DESCRIPTION OF THE DRAWINGS

In order to better understand the terms in which this descriptive report is written, two sheets of drawings are attached in which the following has been represented in an illustrative but not limiting way.

DETAILED DESCRIPTION OF THE INVENTION

Figure 1:
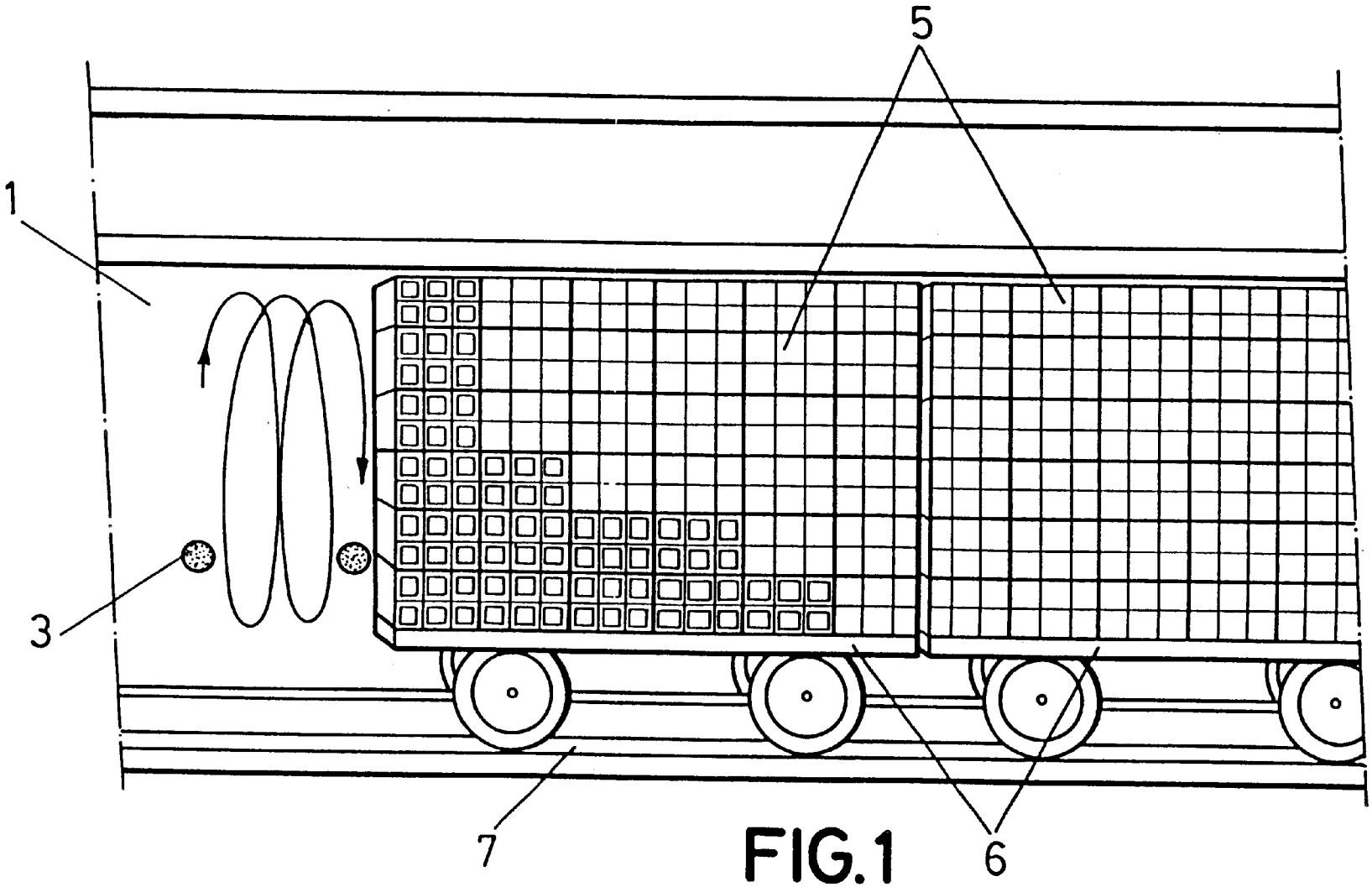
FIG. 1 shows a sectional view of the invention where the wagons that contain the bricks, nozzles and, by means of a spiral curve, the shape of the hot air current created along the inside of the main body of the furnace can be seen.
Figure 2:
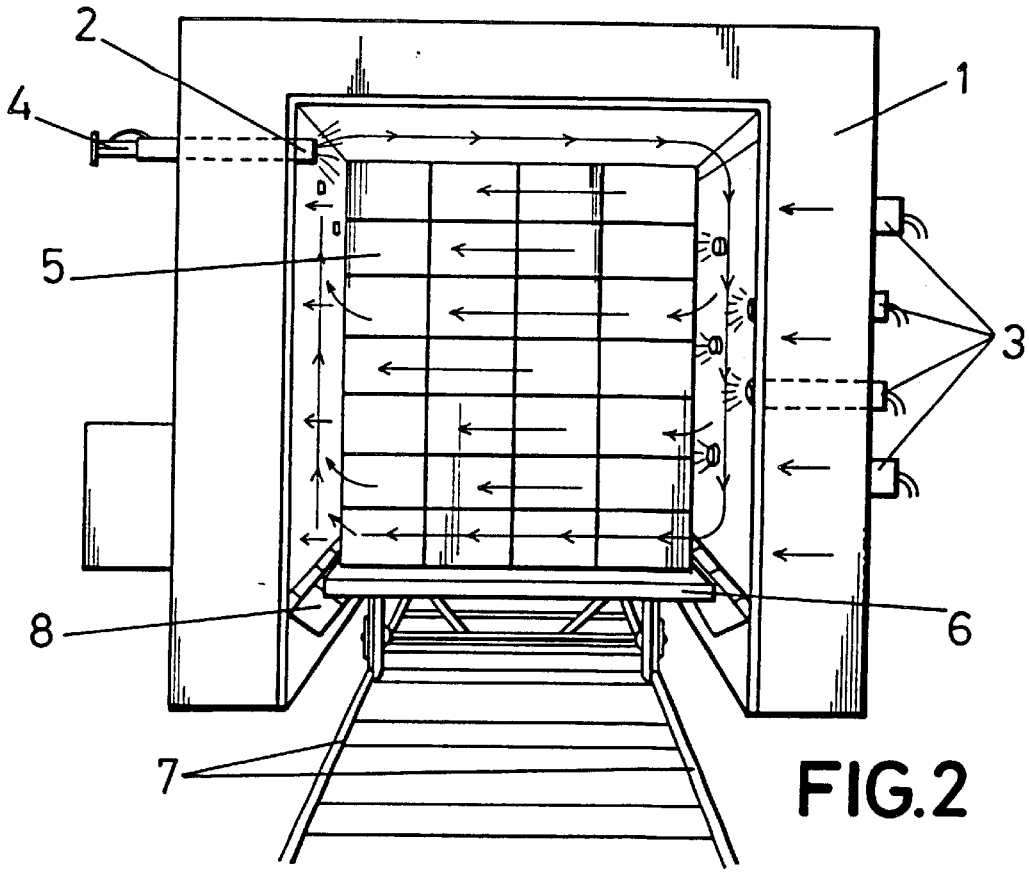
FIG. 2 shows a perspective view of the invention from the inlet mouth where a wagon loaded with bricks and, by means of a line with arrows, the hot air flow lines can be seen.
Figure 3:
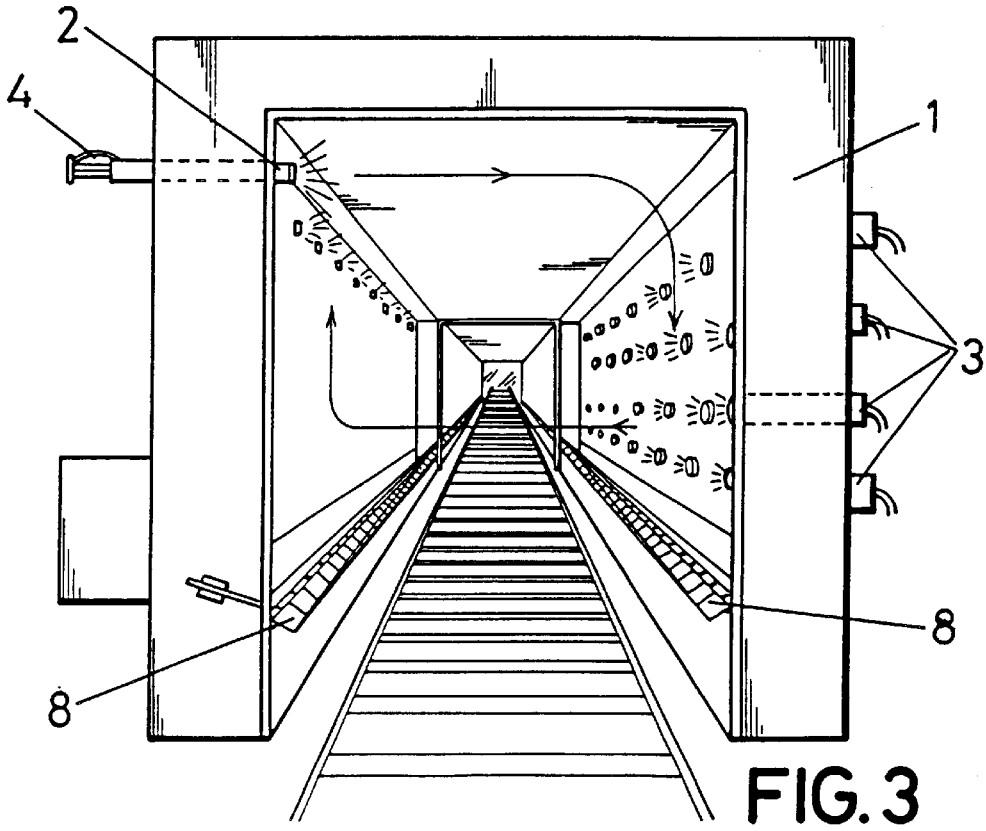
FIG. 3 shows the same object that represents the above FIG. 2 but without the brick wagon, so that observing the hot air nozzles and blowers in depth is possible.

In view of the figures, it can be seen how the proposed longitudinal continuous furnace applicable to construction ceramic material is made up of a main body of the furnace (1), including a rectangular base prismatic body where one of the sides parallel to the horizontal is comparatively much larger that the other two, appreciably the same sides. The body is in the shape of a squared section tunnel which is covered on the inside by refractory bricks, and the upper area of body has a line of hot air nozzles (2) on one of its inside lateral faces that diffuse the hot air provided by gas burners (4), located coaxially on the outside area of the main body of the furnace (1).

The diffused air temperature may vary by means of modifying the gas flow with which the mentioned gas burners (4) are supplied.

It can also be that on the opposite inside face, there are a number of blowers (3) which are supplied by means of compressed air at ambient temperature. The mission of the blowers is to create convection currents inside the main body of the furnace (1) to permit rapid drying and baking of the bricks (5) that go through the inside of the invention a low speed on wagons (6) that circulate on rails (7).

The bricks (5) must be placed on the wagons so that their holes are aligned according to the normal direction of the larger size of the main body of the furnace (1) to facilitate the formation of the convection currents and so that these easily penetrate inside said bricks (5).

On the inside area of the main body of the furnace (1), in the region where the horizontal surface of the wagons (6) passes by, there is a projection (8) on each lateral wall in order to prevent the air current flow through the inferior area of the wagons (6), creating longitudinal flows that come into contact with the bricks (5) placed inside the invention. In the same way, the brick load (5) must be placed near the ceiling and walls of the main body of the furnace (1)

In the preferred performance of the invention, the main body of the furnace (1) is manufactured in brickwork, although it can be perfectly made in steel provided with suitable insulating components.

What is claimed is:

1. A longitudinal continuous furnace applicable to construction material, comprising a main body of the furnace (1), manufactured in brickwork and covered inside by refractory bricks, said main body having on its inside lateral walls a line of nozzles (2) that spread hot air generated in gas burners (4) located coaxially, said main body having an opposite interior wall with a number of blowers (3) that inject pressurized air at ambient temperature from the outside and said main body having some rails (7) on the floor along which wagons (6) transporting the bricks (5) to be baked can circulate.

2. Said longitudinal continuous furnace applicable to construction ceramic material, according to claim 1, wherein inside the main body of the furnace (1) there is a projection (8) located in the region through which the horizontal surface of the wagons (6) circulates.

* * * * *